US011594240B2

(12) United States Patent
Ganeshkumar et al.

(10) Patent No.: US 11,594,240 B2
(45) **Date of Patent: *Feb. 28, 2023**

(54) AUDIO SIGNAL PROCESSING FOR NOISE REDUCTION

(71) Applicant: Bose Corporation, Framingham, MA (US)

(72) Inventors: Alaganandan Ganeshkumar, North Attleboro, MA (US); Xiang-Ern Yeo, Brighton, MA (US); Mehmet Ergezer, Newton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/930,557

(22) Filed: Jul. 16, 2020

(65) Prior Publication Data

US 2020/0349962 A1 Nov. 5, 2020

Related U.S. Application Data

(63) Continuation of application No. 16/425,529, filed on May 29, 2019, now Pat. No. 10,748,549, which is a (Continued)

(51) Int. Cl.
*G10L 21/0364* (2013.01)
*G10L 21/0232* (2013.01)
(Continued)

(52) U.S. Cl.
CPC ..... *G10L 21/0364* (2013.01); *G10L 21/0208* (2013.01); *G10L 21/0216* (2013.01);
(Continued)

(58) Field of Classification Search
CPC ..... H04R 1/1008; H04R 1/1041; H04R 1/32; H04R 3/005; H04R 1/406; H04R 2430/20;
(Continued)

(56) References Cited

U.S. PATENT DOCUMENTS 7,359,504 B1 4/2008 Reuss et al.
8,249,284 B2 8/2012 Allegro-Baumann et al.
(Continued)

FOREIGN PATENT DOCUMENTS

JP H05064284 A 3/1993
JP 2003-337594 A 11/2003
(Continued)

OTHER PUBLICATIONS

JP Office Action dated Nov. 24, 2020 for JP Appln. 2019-551657.
JP Office Action dated Mar. 22, 2022 for JP Appl. 2021-27423.
JP Office Action dated Mar. 29, 2022 for JP Appln. 2021-27424.

*Primary Examiner* — Norman Yu

(57) ABSTRACT

A headphone, headphone system, and speech enhancing method is provided to enhance speech pick-up from the user of a headphone and includes receiving a plurality of signals from a set of microphones and generating a primary signal by array processing the microphone signals to steer a beam toward the user's mouth. A noise reference signal is also derived from one or more microphones via a delay-and-sum technique, and a voice estimate signal is generated by filtering the primary signal to remove components that are correlated to the noise reference signal.

9 Claims, 5 Drawing Sheets

Related U.S. Application Data continuation of application No. 15/463,368, filed on Mar. 20, 2017, now Pat. No. 10,311,889.

(51) Int. Cl.

| | |
|---|---|
| ***H04R 1/40*** | (2006.01) |
| ***H04R 1/10*** | (2006.01) |
| ***G10L 21/0216*** | (2013.01) |
| ***H04R 5/033*** | (2006.01) |
| ***G10L 21/0208*** | (2013.01) |
| *H04R 1/32* | (2006.01) |
| *H04R 3/00* | (2006.01) |

(52) U.S. Cl.

CPC ..... *G10L 21/0232* (2013.01); *H04R 1/1008* (2013.01); *H04R 1/1041* (2013.01); *H04R 1/406* (2013.01); *H04R 5/033* (2013.01); *G10L 2021/02165* (2013.01); *G10L 2021/02166* (2013.01); *H04R 1/32* (2013.01); *H04R 3/005* (2013.01); *H04R 2430/23* (2013.01)

(58) Field of Classification Search

CPC ..... H04R 2201/401; H04R 2410/01; H04R 1/1083; H04R 25/407; H04R 5/033; H04R 2430/23; H04R 2430/25; H04R 29/005; H04R 1/326; H04R 2201/403; H04R 2460/01; H04R 25/405; H04R 2203/12; H04R 2410/05; H04R 2430/21; H04R 1/10; H04R 25/43; G10L 2021/02166; G10L 21/0364; G10L 21/0208; G10L 21/0216; G10L 21/0232; G10L 21/0272; G10L 25/78; G10L 2021/02165; G10L 15/25; G10K 2210/111

USPC ..... 381/74, 26, 309, 317, 71.6, 71.11, 92, 381/94.1–94.3, 94.7, 110, 122

See application file for complete search history.

(56) References Cited

U.S. PATENT DOCUMENTS

| | | | | |
|---|---|---|---|---|
| 2002/0041695 | A1 | 4/2002 | Luo | |
| 2007/0172079 | A1* | 7/2007 | Christoph | H04R 1/406 381/92 |
| 2009/0078105 | A1 | 3/2009 | Maekawa et al. | |
| 2012/0020480 | A1* | 1/2012 | Visser | H04R 3/12 381/17 |
| 2012/0026126 | A1 | 2/2012 | Park et al. | |
| 2014/0093091 | A1* | 4/2014 | Dusan | H04R 1/1083 381/74 |
| 2017/0263267 | A1* | 9/2017 | Dusan | H04R 1/1016 |

FOREIGN PATENT DOCUMENTS

| | | | |
|---|---|---|---|
| JP | 2010271411 | A | 12/2010 |
| JP | 2011030022 | A | 2/2011 |
| JP | 2012058360 | A | 3/2012 |
| JP | 2015037239 | A | 2/2015 |
| JP | 2015097355 | A | 5/2015 |
| JP | 2015165658 | A | 9/2015 |
| JP | 2016015722 | A | 1/2016 |
| KR | 101318328 | B1 | 10/2013 |

* cited by examiner

AUDIO SIGNAL PROCESSING FOR NOISE REDUCTION

PRIORITY CLAIM AND CROSS-REFERENCE

This application is a continuation of, and claims priority to, U.S. patent application Ser. No. 16/425,529, filed May 29, 2019, now U.S. Pat. No. 10,748,549, which is a continuation of U.S. patent application Ser. No. 15/463,368, filed Mar. 20, 2017, now U.S. Pat. No. 10,311,889, the entire contents of which is incorporated herein by reference.

BACKGROUND

Headphone systems are used in numerous environments and for various purposes, examples of which include entertainment purposes such as gaming or listening to music, productive purposes such as phone calls, and professional purposes such as aviation communications or sound studio monitoring, to name a few. Different environments and purposes may have different requirements for fidelity, noise isolation, noise reduction, voice pick-up, and the like. Some environments require accurate communication despite high background noise, such as environments involving industrial equipment, aviation operations, and sporting events. Some applications exhibit increased performance when a user's voice is more clearly separated, or isolated, from other noises, such as voice communications and voice recognition, including voice recognition for communications, e.g., speech-to-text for short message service (SMS), i.e., texting, or virtual personal assistant (VPA) applications.

Accordingly, in some environments and in some applications it may be desirable for enhanced capture or pick-up of a user's voice from among other acoustic sources in the vicinity of a headphone or headset, to reduce signal components that are not due to the user's voice.

SUMMARY OF THE INVENTION

Aspects and examples are directed to headphone systems and methods that pick-up speech activity of a user and reduce other acoustic components, such as background noise and other talkers, to enhance the user's speech components over other acoustic components. The user wears a headphone set, and the systems and methods provide enhanced isolation of the user's voice by removing audible sounds that are not due to the user speaking. Noise-reduced voice signals may be beneficially applied to audio recording, communications, voice recognition systems, virtual personal assistants (VPA), and the like. Aspects and examples disclosed herein allow a headphone to pick-up and enhance a user's voice so the user may use such applications with improved performance and/or in noisy environments.

According to one aspect, a method of enhancing speech of a headphone user is provided and includes receiving a first plurality of signals derived from a first plurality of microphones coupled to the headphone, array processing the first plurality of signals to steer a beam toward the user's mouth to generate a first primary signal, receiving a reference signal derived from one or more microphones, the reference signal correlated to background acoustic noise, and filtering the first primary signal to provide a voice estimate signal by removing from the first primary signal components correlated to the reference signal.

Some examples include deriving the reference signal from the first plurality of signals by array processing the first plurality of signals to steer a null toward the user's mouth.

In some examples, filtering the first primary signal comprises filtering the reference signal to generate a noise estimate signal and subtracting the noise estimate signal from the first primary signal. The method may include enhancing the spectral amplitude of the voice estimate signal based upon the noise estimate signal to provide an output signal. Filtering the reference signal may include adaptively adjusting filter coefficients. In some examples, filter coefficients are adaptively adjusted when the user is not speaking. In some examples, filter coefficients are adaptively adjusted by a background process.

Some examples further include receiving a second plurality of signals derived from a second plurality of microphones coupled to the headphone at a different location from the first plurality of microphones, array processing the second plurality of signals to steer a beam toward the user's mouth to generate a second primary signal, combining the first primary signal and the second primary signal to provide a combined primary signal, and filtering the combined primary signal to provide the voice estimate signal by removing from the combined primary signal components correlated to the reference signal.

The reference signal may comprise a first reference signal and a second reference signal and the method may further include processing the first plurality of signals to steer a null toward the user's mouth to generate the first reference signal and processing the second plurality of signals to steer a null toward the user's mouth to generate the second reference signal.

Combining the first primary signal and the second primary signal may include comparing the first primary signal to the second primary signal and weighting one of the first primary signal and the second primary signal more heavily based upon the comparison.

In certain examples, array processing the first plurality of signals to steer a beam toward the user's mouth includes using a super-directive near-field beamformer.

In some examples, the method includes deriving the reference signal from the one or more microphones by a delay-and-sum technique.

According to another aspect, a headphone system is provided and includes a plurality of left microphones coupled to a left earpiece, a plurality of right microphones coupled to a right earpiece, one or more array processors, a first combiner to provide a combined primary signal as a combination of a left primary signal and a right primary signal, a second combiner to provide a combined reference signal as a combination of a left reference signal and a right reference signal, and an adaptive filter configured to receive the combined primary signal and the combined reference signal and provide a voice estimate signal. The one or more array processors are configured to receive a plurality of left signals derived from the plurality of left microphones and steer a beam, by an array processing technique acting upon the plurality of left signals, to provide the left primary signal, and to steer a null, by an array processing technique acting upon the plurality of left signals, to provide the left reference signal. The one or more array processors are also configured to receive a plurality of right signals derived from the plurality of right microphones and steer a beam, by an array processing technique acting upon the plurality of right signals, to provide the right primary signal, and to steer a null, by an array processing technique acting upon the plurality of right signals, to provide the right reference signal.

In certain examples, the adaptive filter is configured to filter the combined primary signal by filtering the combined reference signal to generate a noise estimate signal and subtracting the noise estimate signal from the combined primary signal. The headphone system may include a spectral enhancer configured to enhance the spectral amplitude of the voice estimate signal based upon the noise estimate signal to provide an output signal. Filtering the combined reference signal may include adaptively adjusting filter coefficients. The filter coefficients may be adaptively adjusted when the user is not speaking. The filter coefficients may be adaptively adjusted by a background process.

In some examples, the headphone system may include one or more sub-band filters configured to separate the plurality of left signals and the plurality of right signals into one or more sub-bands, and wherein the one or more array processors, the first combiner, the second combiner, and the adaptive filter each operate on one or more sub-bands to provide multiple voice estimate signals, each of the multiple voice estimate signals having components of one of the one or more sub-bands. The headphone system may include a spectral enhancer configured to receive each of the multiple voice estimate signals and spectrally enhance each of the voice estimate signals to provide multiple output signals, each of the output signals having components of one of the one or more sub-bands. A synthesizer may be included and be configured to combine the multiple output signals into a single output signal.

In certain examples, the second combiner is configured to provide the combined reference signal as a difference between the left reference signal and the right reference signal.

In some examples, the array processing technique to provide the left and right primary signals is a super-directive near-field beam processing technique.

In some examples, the array processing technique to provide the left and right reference signals is a delay-and-sum technique.

According to another aspect, a headphone is provided and includes a plurality of microphones coupled to one or more earpieces and includes one or more array processors configured to receive a plurality of signals derived from the plurality of microphones, to steer a beam, by an array processing technique acting upon the plurality of signals, to provide a primary signal, and to steer a null, by an array processing technique acting upon the plurality of signals, to provide a reference signal, and includes an adaptive filter configured to receive the primary signal and the reference signal and provide a voice estimate signal.

In some examples, the adaptive filter is configured to filter the reference signal to generate a noise estimate signal and subtract the noise estimate signal from the first primary signal to provide the voice estimate signal. The headphone may include a spectral enhancer configured to enhance the spectral amplitude of the voice estimate signal based upon the noise estimate signal to provide an output signal. Filtering the reference signal may include adaptively adjusting filter coefficients. Filter coefficients may be adaptively adjusted when the user is not speaking. Filter coefficients may be adaptively adjusted by a background process.

In some examples, the headphone may include one or more sub-band filters configured to separate the plurality of signals into one or more sub-bands, and wherein the one or more array processors and the adaptive filter each operate on the one or more sub-bands to provide multiple voice estimate signals, each of the multiple voice estimate signals having components of one of the one or more sub-bands. The headphone may include a spectral enhancer configured to receive each of the multiple voice estimate signals and spectrally enhance each of the voice estimate signals to provide multiple output signals, each of the output signals having components of one of the one or more sub-bands. The headphone may also include a synthesizer configured to combine the multiple output signals into a single output signal.

In certain examples, the array processing technique to provide the primary signal is a super-directive near-field beam processing technique.

In some examples, the array processing technique to provide the reference signal is a delay-and-sum technique.

Still other aspects, examples, and advantages of these exemplary aspects and examples are discussed in detail below. Examples disclosed herein may be combined with other examples in any manner consistent with at least one of the principles disclosed herein, and references to "an example," "some examples," "an alternate example," "various examples," "one example" or the like are not necessarily mutually exclusive and are intended to indicate that a particular feature, structure, or characteristic described may be included in at least one example. The appearances of such terms herein are not necessarily all referring to the same example.

BRIEF DESCRIPTION OF THE DRAWINGS

Various aspects of at least one example are discussed below with reference to the accompanying figures, which are not intended to be drawn to scale. The figures are included to provide illustration and a further understanding of the various aspects and examples, and are incorporated in and constitute a part of this specification, but are not intended as a definition of the limits of the invention. In the figures, identical or nearly identical components illustrated in various figures may be represented by a like numeral. For purposes of clarity, not every component may be labeled in every figure. In the figures.

DETAILED DESCRIPTION

Figure 1:
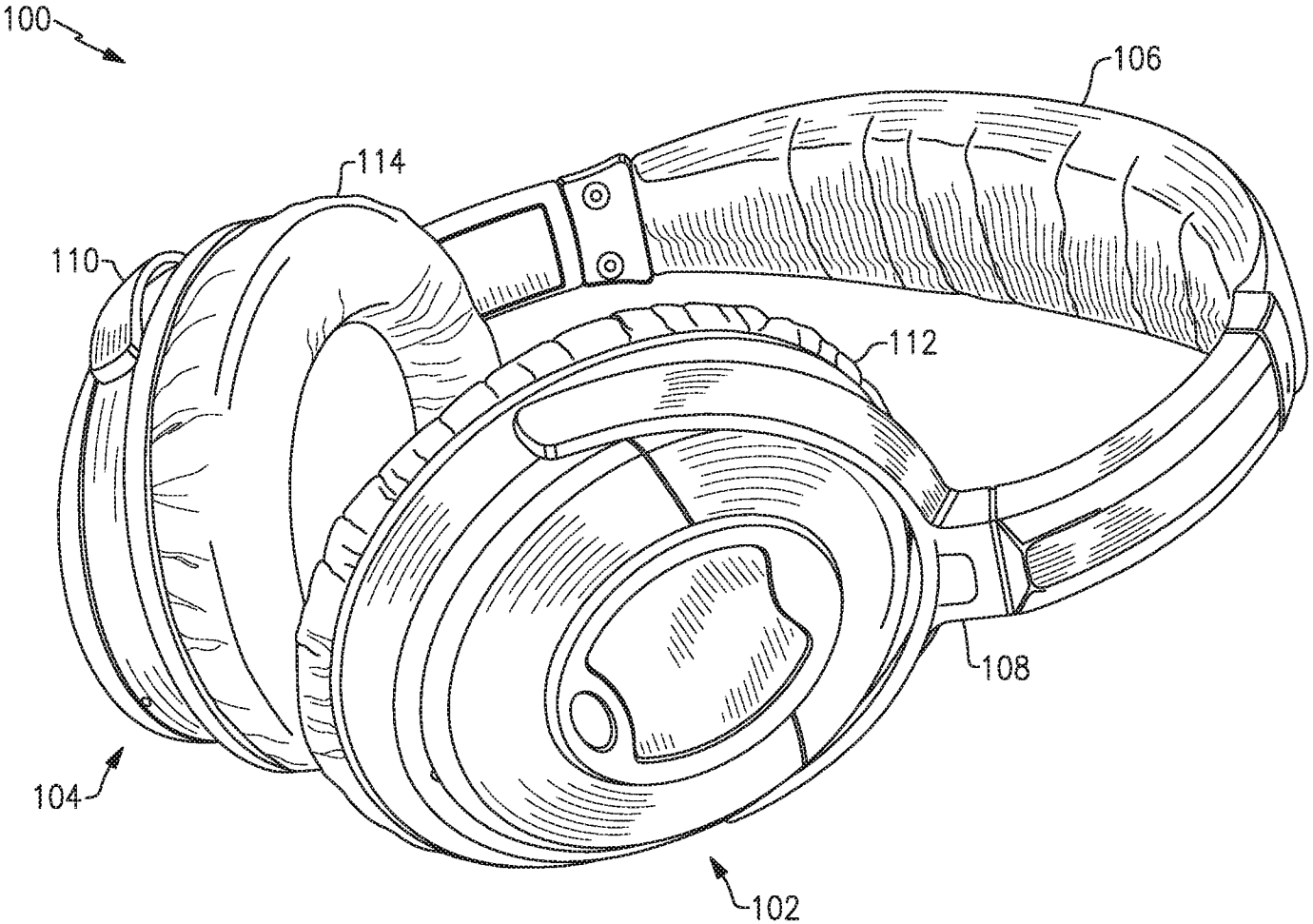
FIG. 1 is a perspective view of an example headphone set.

Aspects of the present disclosure are directed to headphone systems and methods that pick-up a voice signal of the user (e.g., wearer) of a headphone while reducing or removing other signal components not associated with the user's voice. Attaining a user's voice signal with reduced noise components may enhance voice-based features or functions available as part of the headphone set or other associated equipment, such as communications systems (cellular, radio, aviation), entertainment systems (gaming), speech recognition applications (speech-to-text, virtual personal assistants), and other systems and applications that process audio, especially speech or voice. Examples disclosed herein may be coupled to, or placed in connection with, other systems, through wired or wireless means, or may be independent of other systems or equipment.

The headphone systems disclosed herein may include, in some examples, aviation headsets, telephone headsets, media headphones, and network gaming headphones, or any combination of these or others. Throughout this disclosure the terms "headset," "headphone," and "headphone set" are used interchangeably, and no distinction is meant to be made by the use of one term over another unless the context clearly indicates otherwise. Additionally, aspects and examples in accord with those disclosed herein, in some circumstances, may be applied to earphone form factors (e.g., in-ear transducers, earbuds), and are therefore also contemplated by the terms "headset," "headphone," and "headphone set."

Examples disclosed herein may be combined with other examples in any manner consistent with at least one of the principles disclosed herein, and references to "an example," "some examples," "an alternate example," "various examples," "one example" or the like are not necessarily mutually exclusive and are intended to indicate that a particular feature, structure, or characteristic described may be included in at least one example. The appearances of such terms herein are not necessarily all referring to the same example.

It is to be appreciated that examples of the methods and apparatuses discussed herein are not limited in application to the details of construction and the arrangement of components set forth in the following description or illustrated in the accompanying drawings. The methods and apparatuses are capable of implementation in other examples and of being practiced or of being carried out in various ways. Examples of specific implementations are provided herein for illustrative purposes only and are not intended to be limiting. Also, the phraseology and terminology used herein is for the purpose of description and should not be regarded as limiting. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, right and left, top and bottom, upper and lower, and vertical and horizontal are intended for convenience of description, not to limit the present systems and methods or their components to any one positional or spatial orientation.

FIG. 1 illustrates one example of a headphone set. The headphones 100 include two earpieces, i.e., a right earcup 102 and a left earcup 104, coupled to a right yoke assembly 108 and a left yoke assembly 110, respectively, and intercoupled by a headband 106. The right earcup 102 and left earcup 104 include a right circumaural cushion 112 and a left circumaural cushion 114, respectively. While the example headphones 100 are shown with earpieces having circumaural cushions to fit around or over the ear of a user, in other examples the cushions may sit on the ear, or may include earbud portions that protrude into a portion of a user's ear canal, or may include alternate physical arrangements. As discussed in more detail below, either or both of the earcups 102, 104 may include one or more microphones. Although the example headphones 100 illustrated in FIG. 1 include two earpieces, some examples may include only a single earpiece for use on one side of the head only. Additionally, although the example headphones 100 illustrated in FIG. 1 include a headband 106, other examples may include different support structures to maintain one or more earpieces (e.g., earcups, in-ear structures, etc.) in proximity to a user's ear, e.g., an earbud may include a shape and/or materials configured to hold the earbud within a portion of a user's ear.

Figure 2:
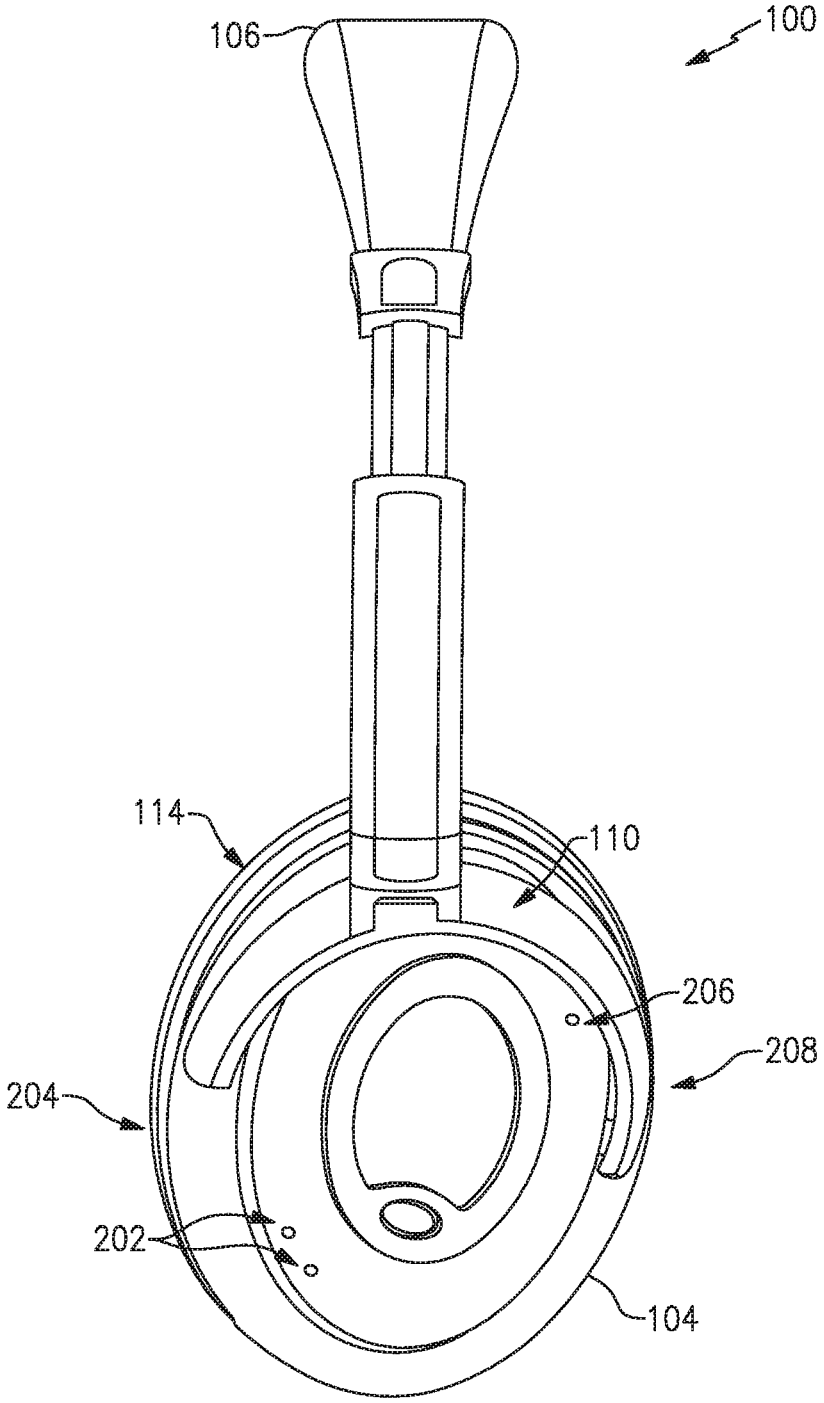
FIG. 2 is a left-side view of an example headphone set.

FIG. 2 illustrates the headphones 100 from the left side and shows details of the left earcup 104 including a pair of front microphones 202, which may be nearer a front edge 204 of the earcup, and a rear microphone 206, which may be nearer a rear edge 208 of the earcup. The right earcup 102 may additionally or alternatively have a similar arrangement of front and rear microphones, though in examples the two earcups may have a differing arrangement in number or placement of microphones. Additionally, various examples may have more or fewer front microphones 202 and may have more, fewer, or no rear microphones 206. While microphones are illustrated in the various figures and labeled with reference numerals, such as reference numerals 202, 206 the visual element illustrated in the figures may, in some examples, represent an acoustic port wherein acoustic signals enter to ultimately reach a microphone 202, 206 which may be internal and not physically visible from the exterior. In examples, one or more of the microphones 202, 206 may be immediately adjacent to the interior of an acoustic port, or may be removed from an acoustic port by a distance, and may include an acoustic waveguide between an acoustic port and an associated microphone.

Signals from the microphones are combined with array processing to advantageously steer beams and nulls in a manner that maximizes the user's voice in one instance to provide a primary signal, and minimizes the user's voice in another instance to provide a reference signal. The reference signal is correlated to the surrounding environmental noise and is provided as a reference to an adaptive filter. The adaptive filter modifies the primary signal to remove components that correlate to the reference signal, e.g., the noise correlated signal, and the adaptive filter provides an output signal that approximates the user's voice signal. Additional processing may occur as discussed in more detail below, and microphone signals from both right and left sides (i.e., binaural), may be combined, also as discussed in more detail below. Further, signals may be advantageously processed in different sub-bands to enhance the effectiveness of the noise reduction, i.e. enhancement of the user's speech over the noise. Production of a signal wherein a user's voice components are enhanced while other components are reduced is referred to generally herein as voice pick-up, voice selection, voice isolation, speech enhancement, and the like. As used herein, the terms "voice," "speech," "talk," and variations thereof are used interchangeably and without regard for whether such speech involves use of the vocal folds.

Examples to pick-up a user's voice may operate or rely on various principles of the environment, acoustics, vocal characteristics, and unique aspects of use, e.g., an earpiece worn or placed on each side of the head of a user whose voice is to be detected. For example, in a headset environment, a user's voice generally originates at a point symmetric to the right and left sides of the headset and will arrive at both a right front microphone and a left front microphone with substantially the same amplitude at substantially the same time with substantially the same phase, whereas background noise, including speech from other people, will tend to be asymmetrical between the right and left, having variation in amplitude, phase, and time.

Figure 3:
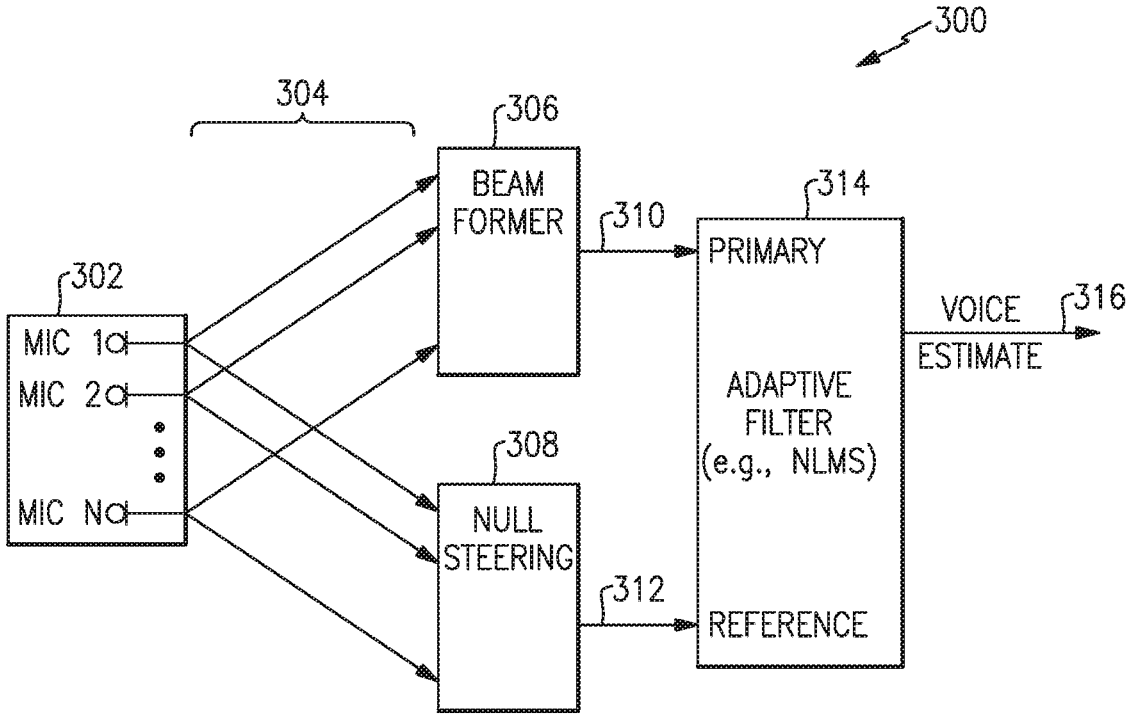
FIG. 3 is a schematic diagram of an example system to enhance a user's voice signal among other acoustic signals.

FIG. 3 is a block diagram of an example signal processing system 300 that processes microphone signals to produce an output signal that includes a user's voice component enhanced with respect to background noise and other talkers. A set of multiple microphones 302 convert acoustic energy into electronic signals 304 and provide the signals 304 to each of two array processors 306, 308. The signals 304 may be in analog form. Alternately, one or more analog-to-digital converters (ADC) (not shown) may first convert the microphone outputs so that the signals 304 may be in digital form.

The array processors 306, 308 apply array processing techniques, such as phased array, delay-and-sum techniques, and may utilize minimum variance distortionless response (MVDR) and linear constraint minimum variance (LCMV) techniques, to adapt a responsiveness of the set of microphones 302 to enhance or reject acoustic signals from various directions. Beam forming enhances acoustic signals from a particular direction, or range of directions, while null steering reduces or rejects acoustic signals from a particular direction or range of directions.

The first array processor 306 is a beam former that works to maximize acoustic response of the set of microphones 302 in the direction of the user's mouth (e.g., directed to the front of and slightly below an earcup), and provides a primary signal 310. Because of the beam forming array processor 306, the primary signal 310 includes a higher signal energy due to the user's voice than any of the individual microphone signals 304.

The second array processor 308 steers a null toward the user's mouth and provides a reference signal 312. The reference signal 312 includes minimal, if any, signal energy due to the user's voice because of the null directed at the user's mouth. Accordingly, the reference signal 312 is composed substantially of components due to background noise and acoustic sources not due to the user's voice, i.e., the reference signal 312 is a signal correlated to the acoustic environment without the user's voice.

In certain examples, the array processor 306 is a super-directive near-field beam former that enhances acoustic response in the direction of the user's mouth, and the array processor 308 is a delay-and-sum algorithm that steers a null, i.e., reduces acoustic response, in the direction of the user's mouth.

The primary signal 310 includes a user's voice component and includes a noise component (e.g., background, other talkers, etc.) while the reference signal 312 includes substantially only a noise component. If the reference signal 312 were nearly identical to the noise component of the primary signal 310, the noise component of the primary signal 310 could be removed by simply subtracting the reference signal 312 from the primary signal 310. In practice, however, the noise component of the primary signal 310 and the reference signal 312 are not identical. Instead, the reference signal 312 is correlated to the noise component of the primary signal 310, as will be understood by one of skill in the art, and thus adaptive filtration may be used to remove at least some of the noise component from the primary signal 310, by using the reference signal 312 that is correlated to the noise component.

The primary signal 310 and the reference signal 312 are provided to, and are received by, an adaptive filter 314 that seeks to remove from the primary signal 310 components not associated with the user's voice. Specifically, the adaptive filter 314 seeks to remove components that correlate to the reference signal 312. Numerous adaptive filters, known in the art, are designed to remove components correlated to a reference signal. For example, certain examples include a normalized least mean square (NLMS) adaptive filter, or a recursive least squares (RLS) adaptive filter. The output of the adaptive filter 314 is a voice estimate signal 316, which represents an approximation of a user's voice signal.

Example adaptive filters 314 may include various types incorporating various adaptive techniques, e.g., NLMS, RLS. An adaptive filter generally includes a digital filter that receives a reference signal correlated to an unwanted component of a primary signal. The digital filter attempts to generate from the reference signal an estimate of the unwanted component in the primary signal. The unwanted component of the primary signal is, by definition, a noise component. The digital filter's estimate of the noise component is a noise estimate. If the digital filter generates a good noise estimate, the noise component may be effectively removed from the primary signal by simply subtracting the noise estimate. On the other hand, if the digital filter is not generating a good estimate of the noise component, such a subtraction may be ineffective or may degrade the primary signal, e.g., increase the noise. Accordingly, an adaptive algorithm operates in parallel to the digital filter and makes adjustments to the digital filter in the form of, e.g., changing weights or filter coefficients. In certain examples, the adaptive algorithm may monitor the primary signal when it is known to have only a noise component, i.e., when the user is not talking, and adapt the digital filter to generate a noise estimate that matches the primary signal, which at that moment includes only the noise component.

The adaptive algorithm may know when the user is not talking by various means. In at least one example, the system enforces a pause or a quiet period after triggering speech enhancement. For example, the user may be required to press a button or speak a wake-up command and then pause until the system indicates to the user that it is ready. During the required pause the adaptive algorithm monitors the primary signal, which does not include any user speech, and adapts the filter to the background noise. Thereafter when the user speaks the digital filter generates a good noise estimate, which is subtracted from the primary signal to generate the voice estimate, for example, the voice estimate signal 316.

In some examples an adaptive algorithm may substantially continuously update the digital filter and may freeze the filter coefficients, e.g., pause adaptation, when it is detected that the user is talking. Alternately, an adaptive algorithm may be disabled until speech enhancement is required, and then only updates the filter coefficients when it is detected that the user is not talking. Some examples of systems that detect whether the user is talking are described in co-pending U.S. patent application Ser. No. 15/463,259, titled SYSTEMS AND METHODS OF DETECTING SPEECH ACTIVITY OF HEADPHONE USER, filed on Mar. 20, 2017, and hereby incorporated by reference in its entirety.

In certain examples, the weights and/or coefficients applied by the adaptive filter may be established or updated by a parallel or background process. For example, an additional adaptive filter may operate in parallel to the adaptive filter 314 and continuously update its coefficients in the background, i.e., not affecting the active signal processing shown in the example system 300 of FIG. 3, until such time as the additional adaptive filter provides a better voice estimate signal. The additional adaptive filter may be referred to as a background or parallel adaptive filter, and when the parallel adaptive filter provides a better voice estimate, the weights and/or coefficients used in the parallel adaptive filter may be copied over to the active adaptive filter, e.g., the adaptive filter 314.

In certain examples, a reference signal such as the reference signal 312 may be derived by other methods or by other components than those discussed above. For example, the reference signal may be derived from one or more separate microphones with reduced responsiveness to the user's voice, such as a rear-facing microphone, e.g., the rear microphone 206. Alternately the reference signal may be derived from the set of microphones 302 using beam forming techniques to direct a broad beam away from the user's mouth, or may be combined without array or beam forming techniques to be responsive to the acoustic environment generally without regard for user voice components included therein.

The example system 300 may be advantageously applied to a headphone system, e.g., the headphones 100, to pick-up a user's voice in a manner that enhances the user's voice and reduces background noise. For example, and as discussed in greater detail below, signals from the microphones 202 (FIG. 2) may be processed by the example system 300 to provide a voice estimate signal 316 having a voice component enhanced with respect to background noise, the voice component representing speech from the user, i.e., the wearer of the headphones 100. As discussed above, in certain examples, the array processor 306 is a super-directive near-field beam former that enhances acoustic response in the direction of the user's mouth, and the array processor 308 is a delay-and-sum algorithm that steers a null, i.e., reduces acoustic response, in the direction of the user's mouth. The example system 300 illustrates a system and method for monaural speech enhancement from one array of microphones 302. Discussed in greater detail below are variations to the system 300 that include, at least, binaural processing of two arrays of microphones (e.g., right and left arrays), further speech enhancement by spectral processing, and separate processing of signals by sub-bands.

Figure 4:
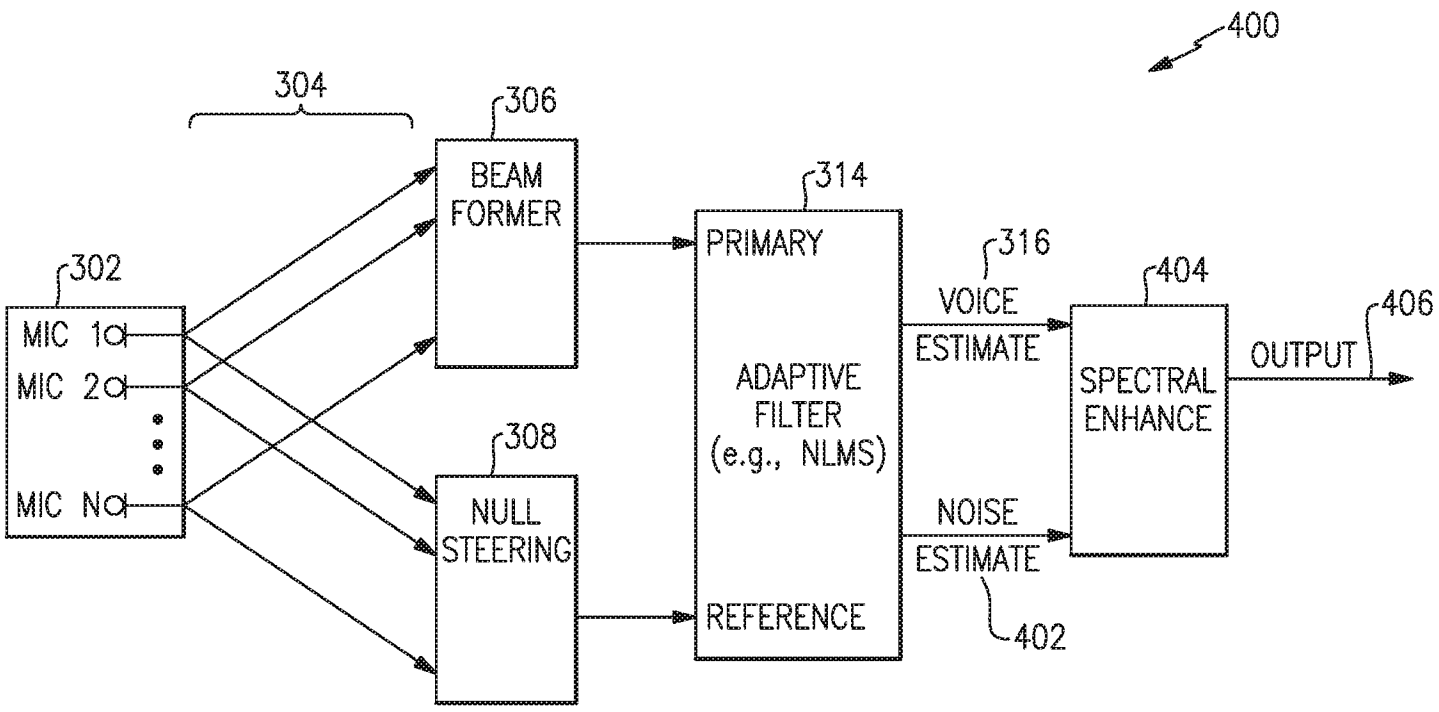
FIG. 4 is a schematic diagram of another example system to enhance a user's voice.

FIG. 4 is a block diagram of a further example of a signal processing system 400 to produce an output signal that includes a user's voice component enhanced with respect to background noise and other talkers. FIG. 4 is similar to FIG. 3, but further includes a spectral enhancement operation 404 performed at the output of the adaptive filter 314.

As discussed above, an example adaptive filter 314 may generate a noise estimate, e.g., noise estimate signal 402. As shown in FIG. 4, the voice estimate signal 316 and the noise estimate signal 402 may be provided to, and received by, a spectral enhancer 404 that enhances the short-time spectral amplitude (STSA) of the speech, thereby further reducing noise in an output signal 406. Examples of spectral enhancement that may be implemented in the spectral enhancer 404 include spectral subtraction techniques, minimum mean square error techniques, and Wiener filter techniques. While the adaptive filter 314 reduces the noise component in the voice estimate signal 316, spectral enhancement via the spectral enhancer 404 may further improve the voice-to-noise ratio of the output signal 406. For example, the adaptive filter 314 may perform better with fewer noise sources, or when the noise is stationary, e.g., the noise characteristics are substantially constant. Spectral enhancement may further improve system performance when there are more noise sources or changing noise characteristics. Because the adaptive filter 314 generates a noise estimate signal 402 as well as a voice estimate signal 316, the spectral enhancer 404 may operate on the two estimate signals, using their spectral content to further enhance the user's voice component of the output signal 406.

As discussed above, the example systems 300, 400 may operate in a digital domain and may include analog-to-digital converters (not shown). Additionally, components and processes included in the example systems 300, 400 may achieve better performance when operating upon narrow-band signals instead of wideband signals. Accordingly, certain examples may include sub-band filtering to allow processing of one or more sub-bands by the example systems 300, 400. For example, beam forming, null steering, adaptive filtering, and spectral enhancement may exhibit enhanced functionality when operating upon individual sub-bands. The sub-bands may be synthesized together after operation of the example systems 300, 400 to produce a single output signal. In certain examples, the signals 304 may be filtered to remove content outside the typical spectrum of human speech. Alternately or additionally, the example systems 300, 400 may be employed to operate on sub-bands. Such sub-bands may be within a spectrum associated with human speech. Additionally or alternately, the example systems 300, 400 may be configured to ignore sub-bands outside the spectrum associated with human speech. Additionally, while the example systems 300, 400 are discussed above with reference to only a single set of microphones 302, in certain examples there may be additional sets of microphones, for example a set on the left side and another set on the right side, to which further aspects and examples of the example systems 300, 400 may be applied, and combined, to provide improved voice enhancement, at least one example of which is discussed in more detail with reference to FIG. 5.

Figure 5:
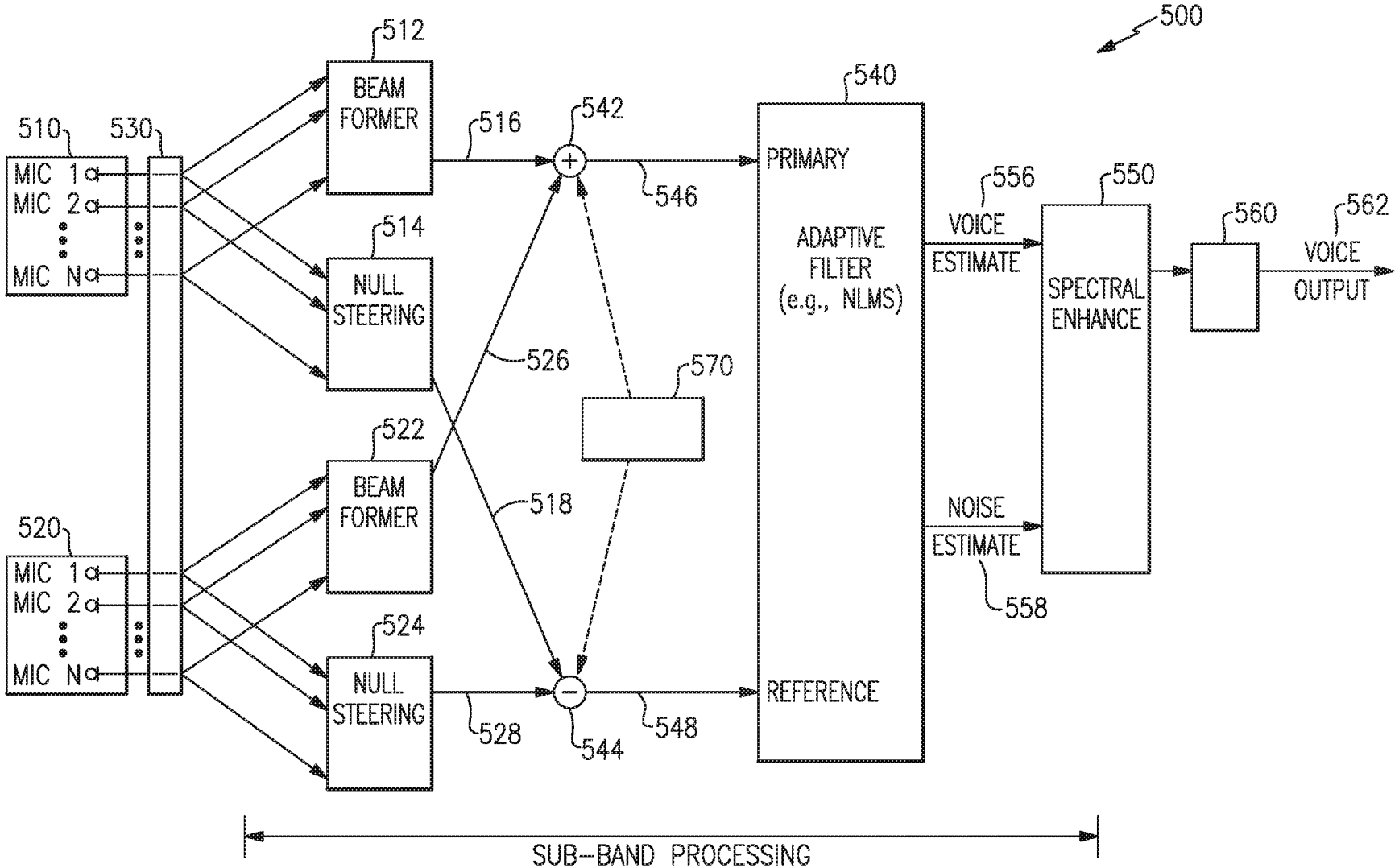
FIG. 5 is a schematic diagram of another example system to enhance a user's voice.

FIG. 5 is a block diagram of an example signal processing system 500 including a right microphone array 510, a left microphone array 520, a sub-band filter 530, a right beam processor 512, a right null processor 514, a left beam processor 522, a left null processor 524, an adaptive filter 540, a combiner 542, a combiner 544, a spectral enhancer 550, a sub-band synthesizer 560, and a weighting calculator 570. The right microphone array 510 includes multiple microphones on the user's right side, e.g., coupled to a right earcup 102 on a set of headphones 100 (see FIGS. 1-2), responsive to acoustic signals on the user's right side. The left microphone array 520 includes multiple microphones on the user's left side, e.g., coupled to a left earcup 104 on a set of headphones 100 (see FIGS. 1-2), responsive to acoustic signals on the user's left side. Each of the right and left microphone arrays 510, 520 may include a single pair of microphones, comparable to the pair of microphones 202 shown in FIG. 2. In other examples, more than two microphones may be provided and used on each earpiece.

In the example shown in FIG. 5, each microphone to be used for speech enhancement in accordance with aspects and examples disclosed herein provides a signal to the sub-band filter 530, which separates spectral components of each microphone into multiple sub-bands. Signals from each microphone may be processed in analog form but preferably are converted to digital form by one or more ADC's associated with each microphone, or associated with the sub-band filter 530, or otherwise acting on each microphone's output signal between the microphone and the sub-band filter 530, or elsewhere. Accordingly, in certain examples the sub-band filter 530 is a digital filter acting upon digital signals derived from each of the microphones. Any of the ADC's, the sub-band filter 530, and other components of the example system 500 may be implemented in a digital signal processor (DSP) by configuring and/or programming the DSP to perform the functions of, or act as, any of the components shown or discussed.

The right beam processor 512 is a beam former that acts upon signals from the right microphone array 510 in a manner to form an acoustically responsive beam directed toward the user's mouth, e.g., below and in front of the user's right ear, to provide a right primary signal 516, so-called because it includes an increased user voice component due to the beam directed at the user's mouth. The right null processor 514 acts upon signals from the right microphone array 510 in a manner to form an acoustically unresponsive null directed toward the user's mouth to provide a right reference signal 518, so-called because it includes a reduced user voice component due to the null directed at the user's mouth. Similarly, the left beam processor 522 provides a left primary signal 526 from the left microphone array 520, and the left null processor 524 provides a left reference signal from the left microphone array 520. The right primary and reference signals 516, 518 are comparable to the primary and reference signals discussed above with respect to the example systems 300, 400 of FIGS. 3-4. Likewise, the left primary and reference signals 526, 528 are comparable to the primary and reference signals discussed above with respect to the example systems 300, 400 of FIGS. 3-4.

The example system 500 processes the binaural set, right and left, of primary and reference signals, which may improve performance over the monaural example systems 300, 400. As discussed in greater detail below, the weighting calculator 570 may influence how much of each of the left or right primary and reference signals are provided to the adaptive filter 540, even to the extent of providing only one of the left or right set of signals, in which case the operation of system 500 is reduced to a monaural case, similar to the example systems 300, 400.

The combiner 542 combines the binaural primary signals, i.e., the right primary signal 516 and the left primary signal 526, for example by adding them together, to provide a combined primary signal 546. Each of the right primary signal 516 and the left primary signal 526 has a comparable voice component indicative of the user's voice when the user is speaking, at least because the right and left microphone arrays 510, 520 are approximately symmetric and equidistant relative to the user's mouth. Due to this physical symmetry, acoustic signals from the user's mouth arrive at each of the right and left microphone arrays 510, 520 with substantially equal energy at substantially the same time and with substantially the same phase. Accordingly, the user's voice component within the right and left primary signals 516, 526 may be substantially symmetric to each other and reinforce each other in the combined primary signal 546. Various other acoustic signals, e.g., background noise and other talkers, tend not to be right-left symmetric about the user's head and do not reinforce each other in the combined primary signal 546. To be clear, noise components within the right and left primary signals 516, 526 carry through to the combined primary signal 546, but do not reinforce each other in the manner that the user's voice components may. Accordingly, the user's voice components may be more substantial in the combined primary signal 546 than in either of the right and left primary signals 516, 526 individually. Additionally, weighting applied by the weighting calculator 570 may influence whether noise and voice components within each of the right and left primary signals 516, 526 are more or less represented in the combined primary signal 546.

The combiner 544 combines the right reference signal 518 and the left reference signal 528 to provide a combined reference signal 548. In examples, the combiner 544 may take a difference between the right reference signal 518 and the left reference signal 528, e.g., by subtracting one from the other, to provide the combined reference signal 548. Due to the null steering action of the right and left null processors 514, 524, there is minimal, if any, user voice component in each of the right and left reference signals 518, 528. Accordingly there is minimal, if any, user voice component in the combined reference signal 548. For examples in which the combiner 544 is a subtractor, whatever user voice component exists in each of the right and left reference signals 518, 528 is reduced by the subtraction due to the relative symmetry of the user's voice components, as discussed above. Accordingly, the combined reference signal 548 has substantially no user voice component and is instead comprised substantially entirely of noise, e.g., background noise, other talkers. As above, weighting applied by the weighting calculator 570 may influence whether the left or right noise components are more or less represented in the combined reference signal 548.

The adaptive filter 540 is comparable to the adaptive filter 314 of FIGS. 3-4. The adaptive filter 540 receives the combined primary signal 546 and the combined reference signal 548 and applies a digital filter, with adaptive coefficients, to provide a voice estimate signal 556 and a noise estimate signal 558. As discussed above, the adaptive coefficients may be established during an enforced pause, may be frozen whenever the user is speaking, may be adaptively updated whenever the user is not speaking, or may be updated at intervals by a background or parallel process, or may be established or updated by any combination of these.

Also as discussed above, the reference signal, e.g., the combined reference signal 548, is not necessarily equal to the noise component(s) present in the primary signal, e.g., the combined primary signal 546, but is substantially correlated to the noise component(s) in the primary signal. The operation of the adaptive filter 540 is to adapt or "learn" the best digital filter coefficients to convert the reference signal into a noise estimate signal that is substantially similar to the noise component(s) in the primary signal. The adaptive filter 540 then subtracts the noise estimate signal from the primary signal to provide a voice estimate signal. In the example system 500, the primary signal received by the adaptive filter 540 is the combined primary signal 546 derived from the right and left beam formed primary signals (516, 526) and the reference signal received by the adaptive filter 540 is the combined reference signal 548 derived from the right and left null steered reference signals (518, 528). The adaptive filter 540 processes the combined primary signal 546 and the combined reference signal 548 to provide the voice estimate signal 556 and the noise estimate signal 558.

As discussed above, the adaptive filter 540 may generate a better voice estimate signal 556 when there are fewer and/or stationary noise sources. The noise estimate signal 558, however, may substantially represent the spectral content of the environmental noise even if there are more or changing noise sources, and further improvement of the system 500 may be had by spectral enhancement. Accordingly, the example system 500 shown in FIG. 5 provides the voice estimate signal 556 and the noise estimate signal 558 to the spectral enhancer 550, in the same fashion as discussed in greater detail above with respect to the example system 400 of FIG. 4, which may provide improved voice enhancement.

As discussed above, in the example system 500, the signals from the microphones are separated into sub-bands by the sub-band filter 530. Each of the subsequent components of the example system 500 illustrated in FIG. 5 logically represents multiple such components to process the multiple sub-bands. For example, the sub-band filter 530 may process the microphone signals to provide frequencies limited to a particular range, and within that range may provide multiple sub-bands that in combination encompass the full range. In one particular example, the sub-band filter may provide sixty-four sub-bands covering 125 Hz each across a frequency range of 0 to 8,000 Hz. An analog to digital sampling rate may be selected for the highest frequency of interest, for example a 16 kHz sampling rate satisfies the Nyquist-Shannon sampling theorem for a frequency range up to 8 kHz.

Accordingly, to illustrate that each component of the example system 500 illustrated in FIG. 5 represents multiple such components, it is considered that in a particular example the sub-band filter 530 may provide sixty-four sub-bands covering 125 Hz each, and that two of these sub-bands may include a first sub-band, e.g., for the frequencies 1,500 Hz-1,625 Hz, and a second sub-band, e.g., for the frequencies 1,625 Hz-1,750 Hz. A first right beam processor 512 will act on the first sub-band, and a second right beam processor 512 will act on the second sub-band. A first right null processer 514 will act on the first sub-band, and a second right null processor 514 will act on the second sub-band. The same may be said of all the components illustrated in FIG. 5 from the output of the sub-band filter 530 through to the input of the sub-band synthesizer 560, which acts to re-combine all the sub-bands into a single voice output signal 562. Accordingly, in at least one example, there are sixty-four each of the right beam processor 512, right null processor 514, left beam processor 522, left null processor 524, adaptive filter 540, combiner 542, combiner 544, and spectral enhancer 550. Other examples may include more or fewer sub-bands, or may not operate upon sub-bands, for example by not including the sub-band filter 530 and the sub-band synthesizer 560. Any sampling frequency, frequency range, and number of sub-bands may be implemented to accommodate varying system requirements, operational parameters, and applications. Additionally, multiples of each component may nonetheless be implemented in, or performed by, a single digital signal processor or other circuitry, or a combination of one or more digital signal processors and/or other circuitry.

The weighting calculator 570 may advantageously improve performance of the example system 500, or may be omitted altogether in various examples. The weighting calculator 570 may control how much of the left or right signals are factored into the combined primary signal 546 or the combined reference signal 548, or both. The weighting calculator 570 establishes factors applied by the combiner 542 and the combiner 544. For instance, the combiner 542 may by default add the right primary signal 516 directly to the left primary signal 526, i.e., with equal weighting. Alternatively, the combiner 542 may provide the combined primary signal 546 as a combination formed from a smaller portion of the right primary signal 516 and a larger portion from the left primary signal 526, or vice versa. For example, the combiner 542 may provide the combined primary signal 546 as a combination such that 40% is formed from the right primary signal 516 and 60% from the left primary signal 526, or any other suitable unequal combination. The weighting calculator 570 may monitor and analyze any of the microphone signals, such as one or more of the right microphones 510 and the left microphones 520, or may monitor and analyze any of the primary or reference signals, such as the right primary signal 516 and left primary signal 526 and/or the right reference signal 518 and left reference signal 528, to determine an appropriate weighting for either or both of the combiners 542, 544.

In certain examples, the weighting calculator 570 analyzes the total signal amplitude, or energy, of any of the right and left signals and more heavily weights whichever side has the lower total amplitude or energy. For example, if one side has substantially higher amplitude, such may indicate the presence of wind or other sources of noise affecting that side's microphone array. Accordingly, reducing the weight of that side's primary signal into the combined primary signal 546 effectively reduces the noise, e.g., increases the voice-to-noise ratio, in the combined primary signal 546, and may improve the performance of the system. In similar fashion, the weighting calculator 570 may apply a similar weighting to the combiner 544 so one of the right or left side reference signals 518, 528 more heavily influences the combined reference signal 548.

The voice output signal 562 may be provided to various other components, devices, features, or functions. For example, in at least one example the voice output signal 562 is provided to a virtual personal assistant for further processing, including voice recognition and/or speech-to-text processing, which may further be provided for internet searching, calendar management, personal communications, etc. The voice output signal 562 may be provided for direct communications purposes, such as a telephone call or radio transmission. In certain examples, the voice output signal 562 may be provided in digital form. In other examples, the voice output signal 562 may be provided in analog form. In certain examples, the voice output signal 562 may be provided wirelessly to another device, such as a smartphone or tablet. Wireless connections may be by Bluetooth® or near field communications (NFC) standards or other wireless protocols sufficient to transfer voice data in various forms. In certain examples, the voice output signal 562 may be conveyed by wired connections. Aspects and examples disclosed herein may be advantageously applied to provide a speech enhanced voice output signal from a user wearing a headset, headphones, earphones, etc. in an environment that may have additional acoustic sources such as other talkers, machinery and equipment, aviation and aircraft noise, or any other background noise sources.

In the example systems 300, 400, 500 discussed above, primary signals are provided with enhanced user voice components in part by using beam forming techniques. In certain examples, the beam former(s) (e.g., array processors 306, 512, 522) use super-directive near-field beam forming to steer a beam toward a user's mouth in a headphone application. The headphone environment is challenging in part because there is typically not much room to have numerous microphones on a headphone form factor. Conventional wisdom holds that to effectively isolate other sources, e.g., noise sources, with beam forming techniques requires, or works best, when the number of microphones is one more than the number of noise sources. The headphone form factor, however, fails to allow room for enough microphones to satisfy this conventional condition in noisy environments, which typically include numerous noise sources. Accordingly, certain examples of the beam formers discussed in the example systems herein implement super-directive techniques and take advantage of near-field aspects of the user's voice, e.g., that the direct path of a user's speech is a dominant component of the signals received by the (relatively few, e.g., two in some cases) microphones due to the proximity of the user's mouth, as opposed to noise sources that tend to be farther away and not dominant. Also as discussed above, certain examples include a delay-and-sum implementation of the various null steering components (e.g., array processors 308, 514, 524). Further, conventional systems in a headphone application fail to provide adequate results in the presence of wind noise. Certain examples herein incorporate binaural weighting (e.g., by the weighting calculator 570 acting upon combiners 542, 544) to switch between sides, when necessary, to accommodate and compensate for wind conditions. Accordingly, certain aspects and examples provided herein provide enhanced performance in a headphone/headset application by using one or more of super-directive near-field beam forming, delay-and-sum null steering, binaural weighting factors, or any combination of these.

Certain examples may include a low power or standby mode to reduce energy consumption and/or prolong the life of an energy source, such as a battery. For example, and as discussed above, a user may be required to press a button (e.g., Push-to-Talk (PTT)) or say a wake-up command before talking. In such cases, the example systems 300, 400, 500 may remain in a disabled, standby, or low power state until the button is pressed or the wake-up command is received. Upon receipt of an indication that the system is required to provide enhanced voice (e.g., button press or wake-up command) the various components of the example systems 300, 400, 500 may be powered up, turned on, or otherwise activated. Also as discussed previously, a brief pause may be enforced to establish weights and/or filter coefficients of an adaptive filter based upon background noise (e.g., without the user's voice) and/or to establish binaural weighting by, e.g., the weighting calculator 570, based upon various factors, e.g., wind or high noise from the right or left side. Additional examples include the various components remaining in a disabled, standby, or low power state until voice activity is detected, such as with a voice activity detection module as briefly discussed above.

One or more of the above described systems and methods, in various examples and combinations, may be used to capture the voice of a headphone user and isolate or enhance the user's voice relative to background noise, echoes, and other talkers. Any of the systems and methods described, and variations thereof, may be implemented with varying levels of reliability based on, e.g., microphone quality, microphone placement, acoustic ports, headphone frame design, threshold values, selection of adaptive, spectral, and other algorithms, weighting factors, window sizes, etc., as well as other criteria that may accommodate varying applications and operational parameters.

It is to be understood that any of the functions of methods and components of systems disclosed herein may be implemented or carried out in a digital signal processor (DSP), a microprocessor, a logic controller, logic circuits, and the like, or any combination of these, and may include analog circuit components and/or other components with respect to any particular implementation. Any suitable hardware and/or software, including firmware and the like, may be configured to carry out or implement components of the aspects and examples disclosed herein.

Having described above several aspects of at least one example, it is to be appreciated various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

What is claimed is:

1. A method of enhancing speech of a headphone user, the method comprising:

receiving a first plurality of signals derived from a first plurality of microphones coupled to the headphone;

array processing the first plurality of signals to steer a beam toward the user's mouth to generate a first primary signal;

receiving a reference signal derived from one or more of the first plurality of microphones, the reference signal correlated to background acoustic noise;

filtering the first primary signal to provide a voice estimate signal by removing from the first primary signal components correlated to the reference signal, wherein the reference signal is derived from the one or more of the first plurality of microphones by a delay-and-sum technique, and wherein the method further comprises:

receiving a second plurality of signals derived from a second plurality of microphones coupled to the headphone at a different location from the first plurality of microphones;

array processing the second plurality of signals to steer a beam toward the user's mouth to generate a second primary signal;

combining the first primary signal and the second primary signal to provide a combined primary signal; and filtering the combined primary signal to provide the voice estimate signal by removing from the combined primary signal components correlated to the reference signal.

2. The method of claim 1 further comprising deriving the reference signal from the first plurality of signals by array processing the first plurality of signals to steer a null toward the user's mouth.

3. The method of claim 1 wherein filtering the first primary signal comprises filtering the reference signal to generate a noise estimate signal and subtracting the noise estimate signal from the first primary signal.

4. The method of claim 3 further comprising enhancing the spectral amplitude of the voice estimate signal based upon the noise estimate signal to provide an output signal.

5. The method of claim 3 wherein filtering the reference signal comprises adaptively adjusting filter coefficients.

6. The method of claim 5 wherein adaptively adjusting filter coefficients comprises at least one of a background process and monitoring when the user is not speaking.

7. The method of claim 1 wherein the reference signal comprises a first reference signal and a second reference signal and further comprising processing the first plurality of signals to steer a null toward the user's mouth to generate the first reference signal and processing the second plurality of signals to steer a null toward the user's mouth to generate the second reference signal.

8. The method of claim 1 wherein combining the first primary signal and the second primary signal comprises comparing the first primary signal to the second primary signal and weighting one of the first primary signal and the second primary signal more heavily based upon the comparison.

9. The method of claim 1 wherein array processing the first plurality of signals to steer a beam toward the user's mouth includes using a super-directive near-field beamformer.

* * * * *